US007607549B2

(12) United States Patent
Morini

(10) Patent No.: US 7,607,549 B2
(45) Date of Patent: Oct. 27, 2009

(54) CAPSULE CONTAINING A MIXER SUBSTANCE FOR BOTTLES CONTAINING PRESSURISED LIQUIDS

(75) Inventor: Emilio Morini, Colorno (IT)

(73) Assignee: Bormioli Rocco & Figlio S.p.A., Parma (IT)

( * ) Notice: Subject to any disclaimer, the term of this patent is extended or adjusted under 35 U.S.C. 154(b) by 488 days.

(21) Appl. No.: 10/513,044

(22) PCT Filed: Apr. 30, 2002

(86) PCT No.: PCT/IT02/00283

§ 371 (c)(1),
(2), (4) Date: Nov. 1, 2004

(87) PCT Pub. No.: WO03/093128

PCT Pub. Date: Nov. 13, 2003

(65) Prior Publication Data

US 2005/0161348 A1 Jul. 28, 2005

(51) Int. Cl.

| | |
|---|---|
| ***B65D 39/00*** | (2006.01) |
| ***B65D 81/32*** | (2006.01) |
| ***B67D 5/00*** | (2006.01) |
| ***B65D 25/08*** | (2006.01) |
| ***B65D 43/18*** | (2006.01) |
| ***B65D 17/42*** | (2006.01) |
| ***B65B 7/28*** | (2006.01) |

(52) U.S. Cl. ..... 215/297; 215/252; 215/DIG. 8; 220/259.2; 220/259.4; 220/277; 222/153.02; 222/153.06; 222/145.5; 206/219; 206/222; 53/471; 426/115; 426/120

(58) Field of Classification Search ..... 220/259.3, 220/259.4, 257.1, 258.1, 258.3, 258.4, 254.1, 220/254.6, 254.8, 255, 277, 521; 215/297, 215/DIG. 8, 252, 364, 299, 296; 222/153.06, 222/153.05, 153.14; 426/115, 120; 206/219, 206/220, 222; 53/471

See application file for complete search history.

(56) References Cited

U.S. PATENT DOCUMENTS

| | | | | |
|---|---|---|---|---|
| 2,073,273 | A | 3/1937 | Erna et al. | |
| 5,104,008 | A | 4/1992 | Crisci | |
| 5,251,424 | A * | 10/1993 | Zenger et al. | 53/431 |

(Continued)

FOREIGN PATENT DOCUMENTS

| | | |
|---|---|---|
| DE | 44 10 323 | 9/1995 |

(Continued)

*Primary Examiner*—Robin Hylton
(74) *Attorney, Agent, or Firm*—Young & Thompson

(57) ABSTRACT

The capsule includes a lower cap with a security strip which inserts removably on a mouth of a bottle. The upper part of the lower cap is open and provided with a neck which couples with an upper cap, also having a security strip. A reservoir is provided within the upper cap and has a breakable bottom; the reservoir also internally includes a cutter. The upper cap can move axially downwards with respect to the neck and the bottle, while it is prevented from moving upwards. The capsule also includes an anchoring between the reservoir and the neck of the capsule when the reservoir is inserted in the neck. The process includes filling the bottle with fizzy water, hermetically closing the bottle with a capsule containing substances to be added to the fizzy water, and introducing the substances into the fizzy water before consuming the drink.

8 Claims, 1 Drawing Sheet

U.S. PATENT DOCUMENTS

| | | | | |
|---|---|---|---|---|
| 6,148,996 | A * | 11/2000 | Morini | 206/222 |
| 6,165,523 | A | 12/2000 | Story | |
| 6,372,270 | B1 | 4/2002 | Denny | |
| 6,705,462 | B2 * | 3/2004 | Kasuya | 206/222 |

FOREIGN PATENT DOCUMENTS

| | | | |
|---|---|---|---|
| DE | 4410323 | A1 * | 9/1995 |
| DE | 299 16 436 | | 3/2001 |
| WO | WO 98/38104 | | 9/1998 |

* cited by examiner

CAPSULE CONTAINING A MIXER SUBSTANCE FOR BOTTLES CONTAINING PRESSURISED LIQUIDS

TECHNICAL FIELD

The invention relates to a capsule containing a mixer substance for bottles containing pressurised liquids, and a process for prods fizzy drinks using the capsules.

BACKGROUND ART

The prior art comprises, with extended market penetration, gassy or fizzy drinks, containing aromatic additives, or energy-giving drinks, or drinks containing mineral salts, an with the aim of giving the drink a pleasant taste and offering the drinker advantages deriving from the inclusion of mineral salts and so on. These drinks are at present made in factories, where they are also bottled and sent on for consumption. They arrive at a sales point ready for use.

To close the bottles containing the drinks, various capsules of many kinds are used. These capsules are normally made of plastic and include a safety strip and seals for maintaining the pressure with the bottle.

Capsules of this type are known from WO 98/38104, DE 44 10 323, U.S. Pat. No. 5,104,008, DE 299 16 436 U, U.S. Pat. No. 6,165,523.

The main aim of the present invention is to realise a capsule, completely different from those already known on the market, for closing bottles containing tizzy drinks which, apart from guaranteeing maintenance of pressure inside the bottle, making the fact whether a bottle has been opened or not evident, enabling the bottle to be re-closed, also provides a new process for the production of the fizzy drinks themselves.

An advantage of the present invention is that is provides a capsule which enables considerable economies to be made in the production of many types of bottled fizzy drinks.

A further advantage of the invention is that it provides a capsule which enables the fizzy drink to be produced immediately before it is drunk.

These aims and advantages are achieved by the invention, as it is characterised in the appended claims.

DISCLOSURE OF INVENTION

Further characteristics and advantages of the present invention will better emerge from the detailed description that follows of the various phases of the process, illustrated purely by way of non-limiting example in the accompanying figures of the drawings, in which.

Figure 2:
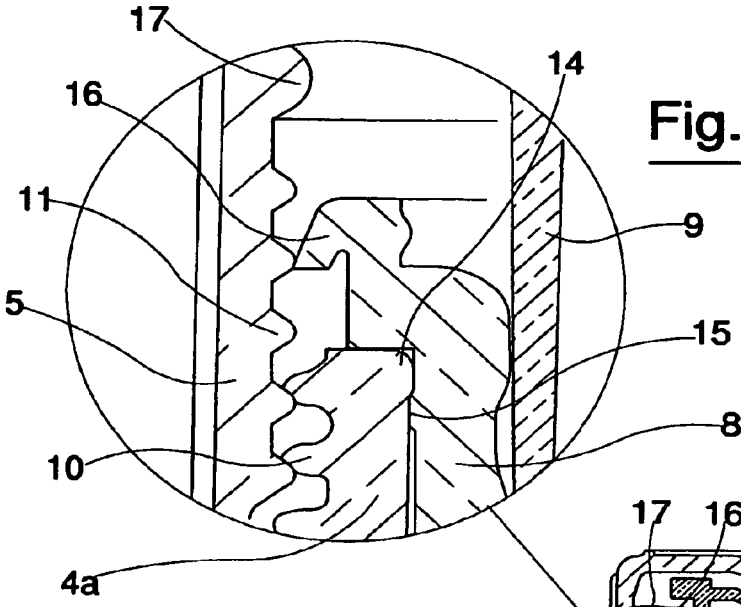
FIG. 2 is a detail in enlarged scale of the capsule of FIG. 1.
Figure 1:
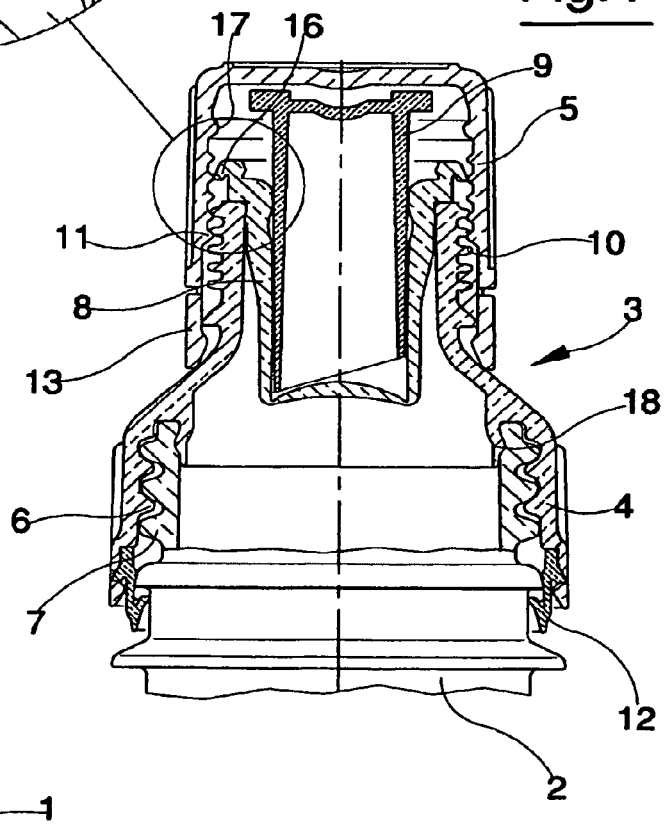
FIG. 1 is a section in vertical elevation of the capsule of the invention.
Figure 3:
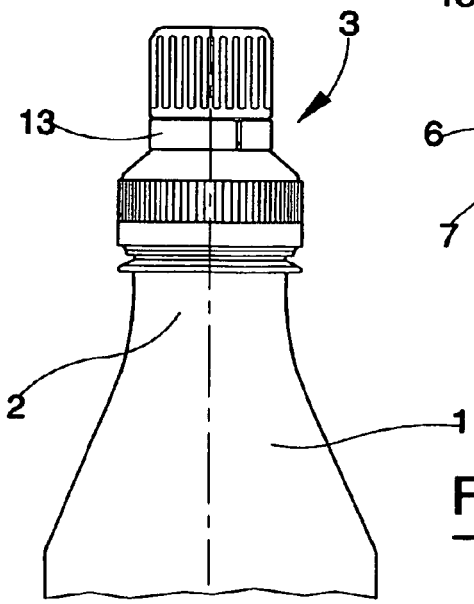
FIG. 3 is a view in vertical elevation of the upper part of a bottle on which a capsule of the type in question has been applied.

In the figures of the drawings, 1 denotes a neck of a bottle, whose mouth is closed by the capsule 3 of the invention.

The capsule 3 comprises a lower cap 4 having an internal thread 6 through which the lower cap 4 can be screwed onto a corresponding thread 7 made on the mouth 2 of the bottle 1. In the lower part of the lower cap 4 there is a safety strip 12 which, at the moment of first unscrewing of the lower cap 4, detaches from the lower cap 4 and thus indicates that the bottle has been opened. The strip 12 is illustrated in the form of a ring, constrained internally of the lower cap 4, a part of which ring, which is joined to the rest of the safety strip by means of easy-break ribs, engages in an annular projection fashioned on the mouth 2 of the bottle and detaches when the lower cap 4 is raised following an unscrewing action.

The strip 12, whose function is the same as other safety strips included in numerous types of capsules for bottles, can be made in a different way to the way illustrated herein above.

The upper part of the lower cap 4 is opened external wise and is provided with a neck 4*a* which has a smaller inferior diameter than an internal diameter of the mouth 2 of the bottle.

The lower cap 4 further comprises an internal annular hoop 18, which is made internally of the cap below the neck 4*a* and in the connection zone between the part of the cap that screws onto the mouth of the bottle and the neck 4*a*. When the lower cap 4 is applied on the bottle the internal annular hoop 18 inserts internally of the mouth 2 of the bottle 1 and in this way a seal against the bottle mouth is obtained.

The lower cap 4, apart from sealingly closing the bottle, forms a second mouth, altogether similar to the mouth of the bottle but having a smaller diameter, to which lower cap 4 an upper cap 5 is coupled with freedom to move axially. Preferably the upper cap 5 is made in a single piece by press-forming or injection moulding.

In order to obtain the desired movements of the upper cap 5 with respect to the neck 4*a* of the lower cap 4 means for coupling are provided which enable a downwards axial movement of the upper cap 5 with respect to the neck 4*a*. The means for coupling-comprise a threaded coupling between the upper cap 5 and the neck 4*a* which is realised by an external thread 10 which is fashioned on an external part of the neck 4*a*, and a corresponding internal thread 11 made internally on the upper cap 5.

The conformation of the above-cited means for coupling must also be such as to prevent an upwards axial movement of the upper cap 5 with respect to the neck 4*a*, once the upper cap 5 has been screwed down on the neck 4*a*. This is achieved by means of an interaction of an external ring 16, which is solidly constrained on a reservoir 8 and is located on an upper external part of the reservoir 8, and exhibits a downwards-facing hook-shaped section, with a first internal annular projection 17 which is fashioned on the internal surface of the lower cap 5 in proximity of an internal bottom thereof. As will better emerge herein below, following the first downwards translation of the upper cap 5 with respect to the neck 4*a* of the lower cap 4, the internal annular projection 17 inserts below the external ring 16, preventing the subsequent rising of the upper cap 5 with respect to the neck 4*a*. The upper cap 5 is provided with a second safety strip 13 made with an annular hoop which develops in an axial direction and which is connected, by means of easy-break ribs, to the lower circumference of the upper cap 5; when the upper cap 5 lowers, the hoop detaches from the upper cap 5 and thus evidences that the upper cap 5 has been rotated. The strip 13 can, however, be made differently to what is described herein above.

The upper cap 5 contains a reservoir 8, with a breakable bottom 8*a*, internally of which a cutter 9 is predisposed. The reservoir 8 is stably and sealedly inserted in the neck 4*a* of the lower cap 4.

The inside of the reservoir 8, or the inside of the cutter 9 if the latter is internally hollow and occupies the internal space of the reservoir 8, is filled with the substance which will be inserted, as will be better described herein below, into the bottle. This substance, whose function is to dissolve in the gassed water contained in the bottle for preparing the drink, is preferably water-soluble and will be of a kind suitable for obtaining a drink having the desired characteristics. Means for hooking are also included, for realising a solid anchoring of the reservoir 8 and the neck 4*a* of the lower cap 4 when the reservoir 8 is inserted on the neck 4*a*.

The means for hooking comprise a second internal annular projection 14, made internally of the neck 4*a* of the lower cap 4, below which an external annular projection 15 fashioned on the external surface of the tank 8 will insert. The insertion of the external annular projection 15 below the second internal annular projection 14 is achieved during assembly of the capsule when the reservoir 8 is press-fitted on the neck 4*a*. After this operation the reservoir 8 stays solidly constrained to the lower cap 4 and guarantees the seal of the mouth of the neck 4*a* to the lower capsule 4.

The described capsule is preferably used on bottles 1 having a capacity of between 0.20 and 2 liters, i.e. usual bottles, generally made of plastic and used for fizzy drinks.

The group constituted by the upper cap 5, the reservoir 8 and the cutter 9 is, from many aspects, similar to known groups, such as for example those taught in EP 963325, belonging to the present applicant, which are used for instantaneous medical preparations. These known groups, which have the double function of inserting the powders contained in the reservoir and of enabling the container to be subsequently opened (generally a vial with a volume of a few cc. containing a solution), aim at immediate consumption of the medicine thus obtained, and are not useful in their present state for bottles containing fizzy drinks, as the internal pressures in the bottle would generate a thrust on the capsule which would cause the immediate expulsion thereof from the mouth of the bottle. Since the diameters of the mouths of the bottles used for containing fizzy drinks are considerably larger than those of the mouths of the vials usually used for medicines, the described effect is considerably amplified.

When assembling the bottle, fizzy water is used. This is done in a known way, such as to maintain the pressure inside the bottle, and thus keep the water gassed, up until complete closure of the bottle. Then the lower cap 4 is inserted on the bottle mouth, generally by pressure and screwing, with the hoop 18 inserting sealingly on the mouth of the bottle. The special conformation of the lower cap 4 leads to the obtaining of a second neck 4*a*, of smaller diameter than the mouth of the bottle, on which the following are inserted: the reservoir 8, containing the powder products, which joints solidly on the neck 4*a* thanks to the presence and interaction of the projections 14 and 1S; and the cutter 9, which inserts in the reservoir 8 and closes it hermetically and sealingly. Sometimes it is better to have the capsule 3, with the powders inside, already pre-prepared and assembled on the mouth 2 in a single operation.

The hermetic seal which enables internal pressure to be maintained is guaranteed by the hoop 18, in the zones of the mouth 2 of the bottle, and by the interference between the projections 14 and 15 in the zone of the neck 4*a* of the lower cap 4. The bottle is thus ready to be sent on for sale.

When the drink is prepared for final consumption, the upper cap 5 is screwed on the neck 4*a* and displaces in an axial direction, downwards. This displacement causes a lowering of the cutter 9 and consequent breaking of the breakable bottom of the reservoir 8 with an ensuing fall of the contained substances, in general powders but also syrup-type products, into the bottle. This action also causes the breaking of the security strip 13. The screwing-down of the upper cap 5 halts when the annular projection 17 inserts below the ring 16 and makes the upper cap 5 and the reservoir 8 solidly constrained in upwards axial movement. The substances which fall into the bottle dissolve in the water and thus prepare the desired drink. During all of these operations the bottle remains hermetically closed.

By unscrewing the lower cap 4 from the mouth 2 of the bottle, apart from the detachment of the security strip 12, there is also the detachment of the entire capsule 3 from the bottle, with consequent opening of the bottle and access to the contents.

By screwing the capsule 3 back on the bottle mouth, some of the drink can be saved for later, keeping a sufficient pressure within the bottle at least for a certain period of time.

The sequences of the described operations will be preferably explained on the capsule 3 itself. In any case, even where the consumer makes a mistake, no great problems should emerge. If a consumer first unscrews the lower cap 4, with a consequent opening of the bottle, it is sufficient to re-screw the capsule on the bottle and recommence the operations, this time in the correct order. If the consumer, after having caused the soluble substance in the reservoir 8 to drop into the water, tries to open the bottle by unscrewing the upper cap 5, thanks to the fact that the upper cap 5 is by now made solid to the reservoir 8, which latter is prevented from rising back due to the interference between the projections 14 and 15, what will happen in fact is that the lower cap 4 will be unscrewed from the mouth 2 of the bottle, which is in fact the correct way to open the bottle.

With the described capsule a process for producing fizzy drinks is obtained which, though already used for the preparation of medicinal substances having non-pressurised solvents, was unthinkable for gassy drinks. The known capsules containing the substances to be inserted in the liquids by their own nature both cause the substances in the container to fall into the liquids and enable the container to be opened for access to its contents, but could never maintain the closure of the container should there be a high pressure inside the container. Bottles containing fizzy drinks have an internal pressure of about 3 bar, a level which could never be supported in the known capsules containing substances to be inserted in liquids. The capsule of the invention, on the other hand, from testing carried out, emerges as suitable for supporting pressures of up to 8-9 bar. The process comprises a stage of bottle-filling, with pressurised water (gassy); as previously mentioned, this stage is done using systems already known for some time. Then the stage of hermetic closure of the bottle is done using a capsule of the type of the invention.

The last stage of the process is carried out by the consumer, not in the factory, immediately before consumption of the contents. This last stage is the true and proper preparation of the drink, and consists in causing, by the actions as above-described, the substances contained in the reservoir 8 to drop into the water. This, as has been described, is done without the bottle being opened.

With this process the number of bottling plants needed can be considerably reduced, as it is no longer necessary to have differentiated bottling plants; it is sufficient to have a single bottling plant for fizzy water combined with a system of insertion of capsules 3 which are all the same but which contain different products, for the obtaining of several different drinks.

Considering that the bottles used for fizzy drinks have capacities of between 0.20 and 2 liters, and must therefore have fairly large mouths so that the consumer can access the contents with ease, the capsule of the invention achieves the double aim of allowing a large mouth for ease of consumption and limiting the bottle opening for the introduction of the substances to be added. In this way the drink is easy to consume and the dimensions of the reservoir 8 are kept to a minimum possible. This is important because the reservoir is the most expensive part of the capsule to manufacture, as well as being the part which experiences the worst problems due to the pressure inside the bottle.

The invention claimed is:

1. A capsule containing a mixer substance for bottles containing pressurized liquids, comprising a lower cap (4) provided with a first security strip (12) and also provided with means for connecting which enable a removable insertion of the capsule onto a mouth (2) of a bottle (1), wherein: the means for connecting comprises a screw-coupling between the lower cap (4) and the mouth (2) of the bottle; an upper part of the lower cap (4) is open externalwise and is provided with a neck (4*a*) externally of which an upper cap (5) couples with freedom to displace in an axial direction, which upper cap (5) is provided with a second security strip (13); the lower cap (4) comprises an internal annular hoop (18), made internally of the lower cap (4) below the neck (4*a*), and destined to insert sealingly internally of the mouth (2) of the bottle when the lower cap (4) is inserted on the bottle; a reservoir (8) being provided internally of the upper cap (5), having a bottom (8*a*) which is breakable, and a cutter (9) being located internally of the upper cap (5), which reservoir (8) is inserted solidly and sealingly in the neck (4*a*) of the lower cap (4); a substance being contained internally of the reservoir (8) which substance is to be inserted into the bottle when the bottom (8*a*) of the reservoir (8) is broken; the capsule (3) comprising means for coupling to enable an axial movement of the upper cap (5) with respect to the neck (4*a*) and in a downwards direction with respect to the bottle; the means for coupling prevent a rising axial movement of the upper cap (5) with respect to the neck (4*a*); means for hooking being provided to realize a solid anchoring between the reservoir (8) and the neck (4*a*) of the lower capsule (4) when the reservoir (8) is inserted on the neck (4*a*).

2. A capsule containing a mixer substance for bottles containing pressurized liquids, comprising:

a lower cap (4) provided with a first security strip (12) and also provided with means for connecting which enable a removable insertion of the capsule onto a mouth (2) of a bottle (1), the means for connecting comprising a screw-coupling between the lower cap (4) and the mouth (2) of the bottle, an upper part of the lower cap (4) being open externalwise and provided with a neck (4*a*);

an upper cap (5) that couples externally of the neck (4*a*) with freedom to displace in an axial direction, the upper cap (5) being provided with a second security strip (13);

the lower cap (4) further comprising an internal annular hoop (18), made internally of the lower cap (4) below the neck (4*a*), and constructed so as to insert sealingly internally of the mouth (2) of the bottle when the lower cap (4) is inserted on the bottle;

a reservoir (8) provided internally of the upper cap (5), to internally contain a substance in the reservoir (8), said substance to be inserted into the bottle when the reservoir (8) is broken;

wherein the capsule (3) comprises means for coupling to enable an axial movement of the upper cap (5) with respect to the neck (4*a*) in a downwards direction with respect to the bottle;

wherein said means for coupling prevents a rising axial movement of the upper cap (5) with respect to the neck (4*a*) and comprises an external thread (10) arranged on an external part of the neck (4*a*) that screw-couples with an internal thread (11) arranged internally of the upper cap (5);

wherein the reservoir includes a bottom (8*a*) that is breakable;

wherein the upper cap (5) further comprises a cutter (9) located internally of the upper cap (5);

wherein the reservoir (8) is inserted solidly and sealingly in the neck (4*a*) of the lower cap (4);

the capsule further comprising:

an external ring (16), solidly constrained to the reservoir (8) and arranged on an external upper part thereof, a section of which has a downwards-facing hook-shape;

a first internal annular projection (17), arranged on an internal surface of the upper cap (5) in proximity of an internal bottom of the upper cap (5) so as to insert below the external ring (16) following a first downwards translation of the upper cap (5) with respect to the neck (4*a*) of the lower cap (4);

means for hooking being provided to realize a solid anchoring between the reservoir (8) and the neck (4*a*) of the lower cap (4) when the reservoir (8) is inserted on the neck (4*a*), wherein said means for hooking comprises a second internal annular projection (14), arranged internally of the neck (4*a*) of the lower cap (4), below which an external annular projection (15) inserts, which external annular projection (15) is arranged on an external surface of the reservoir (8) when the reservoir (8) is inserted on the neck (4*a*).

3. The capsule of claim 2, wherein: the neck (4*a*) of the lower cap (4) has an internal diameter which is smaller than an internal diameter of the mouth (2) of the bottle.

4. A bottle on which the capsule (3) of claim 3 is inserted, having a capacity of between 0.20 and 2 liters.

5. A process for producing fizzy drinks, comprising the following stages: filling a bottle with fizzy water under pressure; hermetic closure of the bottle by a capsule as described in claim 2 containing substances to be added to the water for obtaining a drink; introduction of the substances into the water, obtained by causing an exit of the substances without opening the bottle, immediately before consumption of the drink by a consumer.

6. The process of claim 5, wherein the bottle containing the fizzy water has a capacity of between 0.20 and 2 liters.

7. A process for producing fizzy drinks, comprising the following stages: filling a bottle with fizzy water under pressure; hermetic closure of the bottle by a capsule as described in claim 3 containing substances to be added to the water for obtaining a drink; introduction of the substances into the water, obtained by causing an exit of the substances without opening the bottle, immediately before consumption of the drink by a consumer.

8. The process of claim 7, wherein the bottle containing the fizzy water has a capacity of between 0.20 and 2 liters.

* * * * *

UNITED STATES PATENT AND TRADEMARK OFFICE

CERTIFICATE OF CORRECTION

PATENT NO. : 7,607,549 B2
APPLICATION NO. : 10/513044
DATED : October 27, 2009
INVENTOR(S) : Emilio Morini It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1373 days.

Signed and Sealed this

Twelfth Day of October, 2010

David J. Kappos

David J. Kappos
*Director of the United States Patent and Trademark Office*